US008472854B2

(12) United States Patent
Yamamoto et al.

(10) Patent No.: US 8,472,854 B2
(45) Date of Patent: Jun. 25, 2013

(54) FIXING DEVICE AND IMAGE FORMING APPARATUS PROVIDED WITH THE FIXING DEVICE

(75) Inventors: Koji Yamamoto, Toyokawa (JP); Fumio Masuda, Sakai (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 679 days.

(21) Appl. No.: 12/637,387

(22) Filed: Dec. 14, 2009

(65) Prior Publication Data

US 2010/0150624 A1 Jun. 17, 2010

(30) Foreign Application Priority Data

Dec. 15, 2008 (JP) ..... 2008-318763

(51) Int. Cl.
*G03G 15/20* (2006.01)

(52) U.S. Cl.
USPC ..... 399/329

(58) Field of Classification Search
USPC ..... 399/122, 328, 329; 219/216
See application file for complete search history.

(56) References Cited

U.S. PATENT DOCUMENTS

| | | | | |
|---|---|---|---|---|
| 5,124,755 | A * | 6/1992 | Hediger | 399/329 |
| 6,370,352 | B1 | 4/2002 | Tomita | |
| 7,136,615 | B2 * | 11/2006 | Oohara et al. | 399/329 |
| 7,177,580 | B2 * | 2/2007 | Nakafuji et al. | 399/328 |
| 7,792,477 | B2 * | 9/2010 | Nakamoto et al. | 399/329 |
| 2006/0177251 | A1 * | 8/2006 | Uehara et al. | 399/329 |
| 2006/0285892 | A1 * | 12/2006 | Nakamoto et al. | 399/329 |
| 2009/0016789 | A1 * | 1/2009 | Kim et al. | 399/329 |

FOREIGN PATENT DOCUMENTS

| | | | |
|---|---|---|---|
| JP | 11-174878 | A | 7/1999 |
| JP | 2001-154516 | A | 6/2001 |
| JP | 2007-034276 | A | 2/2007 |
| JP | 2007-057786 | | 3/2007 |
| JP | 2007-206477 | | 8/2007 |
| JP | 2007-219109 | A | 8/2007 |
| JP | 2007-240622 | A | 9/2007 |
| JP | 2010-113206 | | 5/2010 |

OTHER PUBLICATIONS

Office Action (Notification of Reasons for Refusal) dated Feb. 15, 2011, issued in the corresponding Japanese Patent Application No. 2008-318763, and an English Translation thereof.

* cited by examiner

*Primary Examiner* — David Gray
*Assistant Examiner* — Thomas Giampaolo, II
(74) *Attorney, Agent, or Firm* — Buchanan Ingersoll & Rooney PC

(57) ABSTRACT

First belt 51 suspended on first upstream roller 53 and first downstream roller 54, and second belt 52 suspended on second upstream roller 55 and second downstream roller 56 each have a stiffness such that when assumed to be separated from each other, the first belt 51 and the second belt 52 rotate while maintaining an elliptic shape thereof. One of two portions of the first belt 51 facing each other between the first upstream roller 53 and the first downstream roller 54 and one of two portions of the second belt 52 facing each other between the second upstream roller 55 and the second downstream roller 56 are flat as a result of being brought into pressing contact with each other, and a fixing nip is formed therebetween. A toner image is fixed by being heated by heater lamp 57 when recording sheet S passes through the fixing nip.

18 Claims, 6 Drawing Sheets

1

| Fixing temperature (°C) | W/Width (mN/mm) | | | | | |
|---|---|---|---|---|---|---|
| | 0.1 | 1 | 10 | 100 | 1000 | 10000 |
| 150 | × | × | △ | ○ | ○ | ○ |
| 170 | × | △ | ○ | ○ | ○ | ○ |
| 190 | × | ○ | ○ | ○ | ○ | ○ |
| 220 | × | ○ | ○ | ○ | ○ | ○ |

○ : Sufficiently fixed
△ : Apparently sufficiently fixed, but toner comes off when rubbed by hand
× : Judged to be insufficiently fixed by appearance

FIXING DEVICE AND IMAGE FORMING APPARATUS PROVIDED WITH THE FIXING DEVICE

This application is based on application No. 2008-318763 filed in Japan, the content of which is hereby incorporated by references.

BACKGROUND OF THE INVENTION (1) Field of the Invention

The present invention relates to a fixing device that thermally fixes an unfixed image formed on a recording sheet to the recording sheet, and an image forming apparatus provided with the fixing device.

(2) Related Art

In general, image forming apparatuses such as copiers, printers, facsimiles, and MFPs (Multiple Function Peripherals) have a structure that forms a toner image corresponding to image data, transfers the formed toner image onto a recording sheet, and fixes the transferred toner image to the recording sheet using a fixing device.

FIG. 7 is a cross-sectional schematic view for explaining a structure of a fixing device that forms a fixing nip using a pair of belts. This fixing device 70 has a pair of a first belt 71 and a second belt 72 that apply pressure, from left and right, to a recording sheet S which has had a toner image transferred thereon and is conveyed upward. FIG. 7 shows a state where the first belt 71 and the second belt 72 are separated from each other. However, in the actual fixing device 70, the first belt 71 and the second belt 72 are brought into pressing contact with each other at their respective upstream portions (lower side) and downstream portions (upper side) in the conveying direction of the recording sheet S, thereby forming a fixing nip between a portion of the first belt 71 and a portion of the second belt 72 that oppose each other.

The first belt 71 is suspended on a first upstream roller 73 disposed at the upstream side in the conveying direction of the recording sheet S and a first downstream roller 74 disposed at the downstream side of the conveying direction of the recording sheet S, with a predetermined tension (belt tension) applied thereto. The first belt 71 is rotated in a direction indicated by an arrow B, for example, according to the rotation of the first downstream roller 74 which is driven to rotate by a drive motor. Inside the first upstream roller 73, a heater lamp 77 formed in a linear fashion is arranged along an axis direction thereof.

The first upstream roller 73 and the first downstream roller 74 have the same radius r1 and are arranged in parallel with each other. The first upstream roller 73 is biased downward (toward upstream in the conveying direction of the recording sheet S) with a tension spring (not shown) so as to apply a predetermined belt tension F1 along the conveying direction of the recording sheet S, to the first belt 71.

The second belt 72 is suspended on a second upstream roller 75 disposed at the upstream side in the conveying direction of the recording sheet S (lower side) and a second downstream roller 76 disposed at the downstream side in the conveying direction of the recording sheet S (upper side), and rotates in a direction shown by an arrow C. The second upstream roller 75 and the second downstream roller 76 also have the same radius r1 as the first upstream roller 73 and the first downstream roller 74, and are arranged in parallel with each other. The second upstream roller 75 is also biased downward (toward upstream in the conveying direction of the recording sheet S) with a tension spring (not shown) so as to apply the belt tension F1 along the conveying direction of the recording sheet S, to the second belt 75.

The second upstream roller 75 and the second downstream roller 76 are pressed against the first upstream roller 73 and the first downstream roller 74, respectively, via the second belt 72 and the first belt 71, with an equal pressure P1. An upstream nip portion is formed between the first belt 71 and the second belt 72 pressed by the first upstream roller 73 and the second upstream roller 75. A downstream nip portion is formed between the first belt 71 and the second belt 72 pressed by the first downstream roller 74 and the second downstream roller 76. The upstream nip portion and the downstream nip portion have a substantially equal nip pressure. Between the upstream nip portion and the downstream nip portion is a free nip portion where a portion of the first belt 71 and a portion of the second belt 72 that oppose each other run in the same direction at the same speed.

In the fixing device 70 with the above-described structure, the recording sheet S having had the toner image transferred thereon enters the upstream nip portion, passes through the free nip portion and the downstream nip portion, and is discharged. While the recording sheet S passes through the upstream nip portion, the free nip portion, and the downstream nip portion, the unfixed toner image on the recording sheet S is heated by the heater lamp 77 into a molten state and fixed by being pressed to the recording sheet S.

FIG. 8 shows a graph showing distribution of a nip pressure at each of the upstream nip portion, the free nip portion, and the downstream nip portion of the fixing device with the above-described structure. At the free nip portion, while the first belt 71 and the second belt 72 are brought into contact with each other by the belt tension thereof, little nip pressure occurs.

Fixing of the toner image on the recording sheet is completed upon the toner image passing through the upstream nip portion, the free nip portion, and the downstream nip portion, and toner particles are in a molten state when passing through the free nip portion. Accordingly, if little nip pressure occurs at the free nip portion, image slippage may occur, that is, the toner image may slip out of the transfer position on the recording sheet before reaching the downstream nip portion due to vibration of the first belt 71, the second belt 72, or the recording sheet S. Additionally, in a case where the recording sheet S vibrates due to an insufficient pressure applied to the recording sheet S passing through the free nip portion, the recording sheet S may crease when entering the downstream nip portion.

Patent Document 1 (Japanese Patent Application Publication H11-174878) discloses a structure which is approximately the same as that of the fixing device 70 shown in FIG. 7. According to the disclosed structure, a heater is also provided inside the second downstream roller 76. This is in order to suppress occurrence of image defects when unfixed toner images transferred on both surfaces of the recording sheets are fixed.

Patent Document 2 (Japanese Patent Application Publication 2001-154516) also discloses a structure approximately the same as that of the fixing device 70 shown in FIG. 7. In the disclosed structure, the first downstream roller 74 is cooled to prevent creases of the recording sheet due to adhesive properties of toner.

However, neither the structure according to Patent Document 1 nor the structure according to Patent Document 2 is able to reliably prevent image slippage, creases of the recording sheet S, and the like. This is because according to these structures, the free nip portion is formed merely by the mutually opposing belt portions, and the belt tension of the first belt 71 and the second belt 72 is not able to provide a sufficient nip pressure at the free nip portion.

Patent Document 3 (Japanese Patent Application Publication 2007-219109), Patent Document 4 (Japanese Patent Application Publication 2007-34276), and Patent Document 5 (Japanese Patent Application Publication 2007-240622) each disclose a fixing device having a structure in which the inner surface of the first belt is pressed using a pressure pad so as to press the outer circumferential surface of the first belt in against the outer circumferential surface of the second belt.

As each of Patent Documents 3-5 discloses, pressing the inner circumferential surface of the first belt using a pressure pad allows the respective portions of the first belt and the second belt that oppose each other to be mutually in pressing contact, which increases the nip pressure. However, because the pressure pad is slidably in contact with the inner circumferential surface of the first belt, the pressure pad and the first belt may wear with passage of time. As a result, a desired nip pressure may not be stably achieved for a long period of time. Additionally, pressing the inner circumferential surface of the first belt using the pressure pad increases the heat capacity required to heat the first belt because of the heat capacity of the pressure pad. As a result, a heating time (warm-up time) required to raise the temperature of the fixing nip portion to a predetermined temperature becomes longer as well.

SUMMARY OF THE INVENTION

The present invention has been achieved in view of the above problem and aims to provide a fixing device that is able to stably ensure a high nip pressure over a long period of time at a nip portion between a pair of mutually opposing belts, without providing a member for pressing the inner circumferential surface of a belt, and that is also able to reduce the warm-up time, and an image forming apparatus equipped with the fixing device.

In order to achieve the above-mentioned aim, one aspect of the present invention is a fixing device that fixes an unfixed image formed on a recording sheet to the recording sheet by applying heat and pressure to the unfixed image when the recording sheet passes through a fixing nip formed by a first belt and a second belt in pressing contact with each other, the first belt being rotatably suspended on a pair of first rollers, and the second belt being rotatably suspended on a pair of second rollers, wherein the first and second belts have a stiffness such that, under an assumption that the first and second belts rotate in a state of being separated from each other, (a) two portions of the first belt that oppose each other across a first axis passing through a center of each of the first rollers project away from each other in a manner that the two portions are arc-shaped, and (b) two portions of the second belt that oppose each other across a second axis passing through a center of each of the second rollers project away from each other in a manner that the two portions of the second belt are arc-shaped, and one of the two portions of the first belt and one of the two portions of the second belt are in pressing contact with each other.

Also, the image forming apparatus pertaining to the present invention is an image forming apparatus that thermally fixes an unfixed image formed on a recording sheet, using a fixing part, and includes the above-described device as the fixing part.

In the fixing device of the present invention, each of the first belt and the second belt has a stiffness such that, under the assumption that the first belt and the second belt rotate in a state of being separated from each other, the first and second belts each run in an elliptic-shaped rotation path. According to the structure of the fixing device, the nip pressure of the fixing nip is increased because one of two portions of the first belt that each project in a outwardly curved state and one of the two portions of the second belt that each project in a outwardly curved state when the first and second belts are assumed to be separated, are brought into pressing contact with each other. Also, a high nip pressure can be stably secured at the fixing nip for a long period of time. Furthermore, there is no need to provide a member such as a pressure pad for each of the first and second belts to increase the nip pressure. As a result, the heat capacity of the fixing device decreases, whereby the warm-up time can be reduced.

Preferably, when the one of the two portions of the first belt and the one of the two portions of the second belt are in pressing contact with each other, an other one of the two portions of the first belt projects further in a direction away from the one of the two portions of the first belt and an other one of the two portions of the second belt projects further in a direction away from the one of the two portions of the second belt, respectively, than when under the assumption that the first and second belts are separated from each other.

Preferably, the one of the two portions of the first belt and the one of the two portions of the second belt that are in pressing contact with each other are flat.

Preferably, each of the first rollers and a corresponding one of the second rollers are pressed against each other via the first and second belts.

Preferably, a pressure load per unit width denoted by W/b (mN/mm) applied to the second belt by the first belt satisfies W/b (mN/mm)≧1, where $W=1000\cdot384\cdot E\cdot b\cdot t^3\cdot\delta/12\cdot L^3$, E ($mN/mm^2$) is Young's modulus of the first belt, t (mm) is a thickness of the first belt, b (mm) is a width of the first belt, and δ (mm) is a projection amount by which a furthest-projecting point of each of the two portions of the first belt projects, in a direction orthogonal to the first axis, with respect to a corresponding common tangent line of the first rollers under the assumption that the first belt is separated from the second belt.

Preferably, W/b (mN/mm)≧10.

Preferably, W/b (mN/mm)≧100.

Preferably, when in a natural state without being suspended on the first rollers, the first belt is an endless belt in a circular cylindrical shape with a transverse cross section thereof having an outer diameter of ϕ (mm), and satisfies the following expression: $100000\leqq E\cdot t/\phi\leqq2000000$ ($mN/mm^2$).

Preferably, the unfixed image formed on the recording sheet is heated by a heater provided between the first rollers positioned inside a rotation path of the first belt.

Preferably, the heater is one of a heater lamp and an electric coil heater.

Preferably, the unfixed image formed on the recording sheet is heated by a heater according to an electromagnetic induction heating method.

BRIEF DESCRIPTION OF THE DRAWINGS

These and the other objects, advantages and features of the invention will become apparent from the following description thereof taken in conjunction with the accompanying drawings which illustrate a specific embodiment of the invention.

In the drawings.

DESCRIPTION OF THE PREFERRED EMBODIMENT

Figure 1:
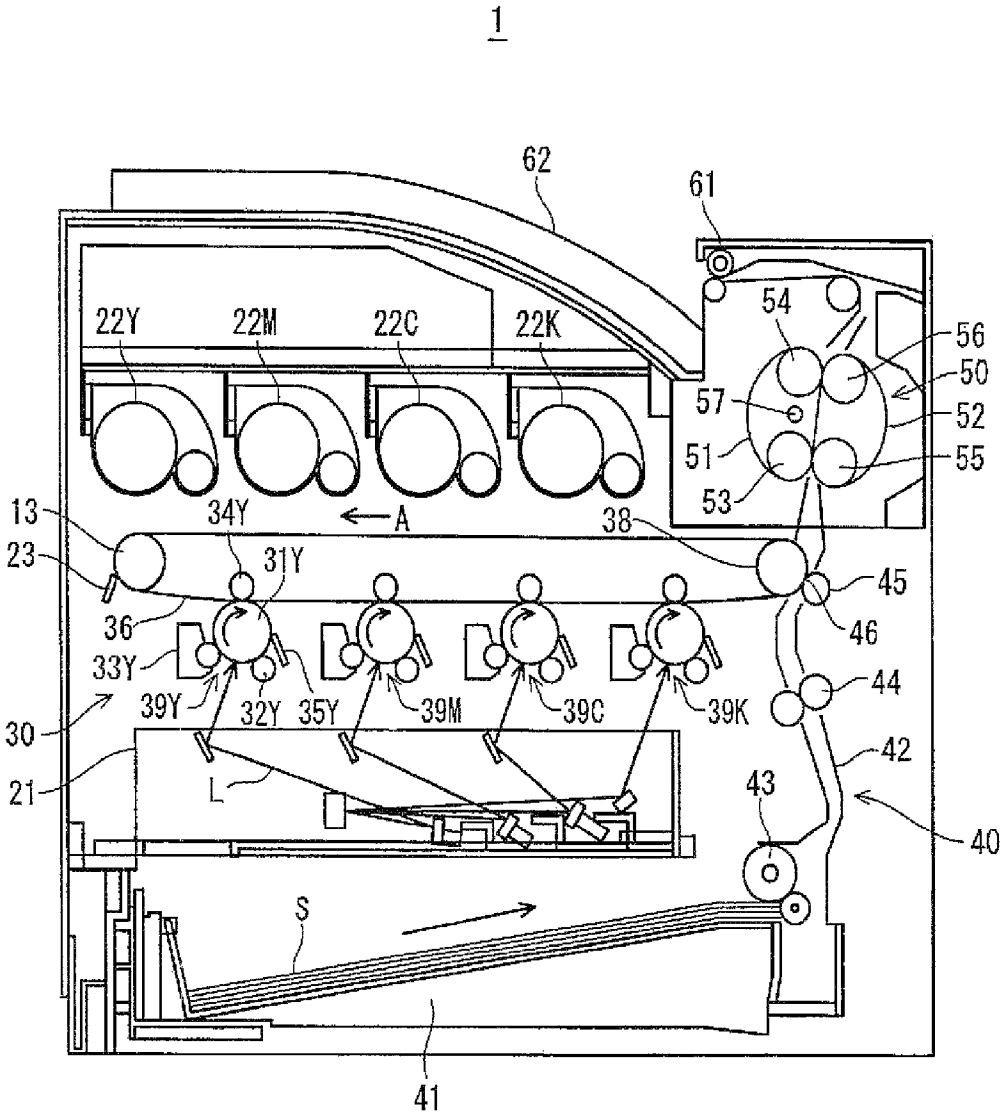
FIG. 1 is a schematic diagram showing an overall general structure of a printer in which a fixing device pertaining to an embodiment of the present invention is provided as a fixing part.

FIG. 1 is a schematic diagram showing a structure of a tandem-type color digital printer (hereinafter, referred to as simply "printer") which uses a fixing device pertaining to the present invention as a fixing part. As shown in FIG. 1, a printer 1 includes an image processing part 30, a sheet conveying part 40, and a fixing device 50. The image processing part 30 forms a toner image; the sheet conveying part 40 conveys a recording sheet S to the image processing unit 30 so that the toner image formed by the image processing part 30 is transferred onto the recording sheet S; and the fixing device 50 constitutes the fixing part fixing the toner image, which has been transferred onto the recording sheet S, to the recording sheet S. Upon receiving an instruction to execute printing (a print job) from a terminal device connected to a network (such as an intra-office LAN), the printer 1 forms a toner image on a recording sheet S in accordance with the instruction.

The image processing part 30 includes an intermediate transfer belt 36, image forming units 39Y, 39M, 39C, and 39K, and an exposing device 21. The intermediate transfer belt 36 rotates in a direction indicated by an arrow A; the image forming units 39Y, 39M, 39C, and 39K are disposed below the intermediate transfer belt 36 along the rotating direction of the intermediate transfer belt 36, in the stated order from the upstream side of intermediate transfer belt 36; and the exposing device 21 emits a laser L to each of the image forming units 39Y, 39M, 39C, and 39K. The intermediate transfer belt 36 is suspended on a driven roller 37 and a driving roller 38, and rotates in the direction indicated by the arrow A according to the rotation of the driving roller 38 which is driven to rotate by a motor (not shown). The driven roller 37 is disposed in a vicinity of the image forming unit 39Y, and the driving roller 38 is disposed in a vicinity of the image forming unit 39K. The intermediate transfer belt 36 has semiconductivity.

The image forming unit 39Y disposed upstream in the moving direction of the intermediate transfer belt 36 includes a photosensitive drum 31Y and forms an yellow (Y) toner image on the photosensitive drum 31Y after each known processing of charging, exposing, and developing. For these processing, the image forming unit 39Y has a charger 32Y, a developer 33Y, a primary transfer roller 34Y, and a cleaner 35Y provided in the stated order along the rotational direction of the photosensitive drum 31Y. The charger 32Y charges the outer circumferential surface of the photosensitive drum 31Y. The developer 33Y develops, using yellow (Y) toner, an electrostatic latent image formed on the outer circumferential surface of the charged photosensitive drum 31Y by the laser L emitted by the exposing device 21. The primary transfer roller 34Y transfers the toner image formed on the outer circumferential surface of the photosensitive drum 31Y onto the intermediate transfer belt 36. The cleaner 35Y cleans the surface of the photosensitive drum 31Y after the toner image is transferred.

The other image forming units 39M, 39C, and 39K each have the same structure as the image forming unite 39Y, and have the following provided therein: a charger for charging the surface of the photosensitive drum; a developer for developing with use of toner an electrostatic latent image formed by the laser L emitted by the exposing device 21; a primary transfer roller for transferring the toner image onto the intermediate transfer belt 36; and a cleaner for cleaning the surface of the photosensitive drum. With the above-described structure, the image forming units 39M, 39C, and 39K form a toner image using toner of magenta (M), cyan (C), and black (K) colors, respectively.

Each charger provided in the image forming units 39Y, 39M, 39C, and 39K can be such as a corona discharge type charger, a roller-shaped charging member, a blade-shaped charging member, or a brush-shaped charging member. In the exposing device 21, light-emitting devices such as laser diodes that are driven by a driving signal corresponding to image data of the respective colors of Y, M, C, and K are provided. The light-emitting devices emit the laser L to the photosensitive drum (such as 31Y) of the image forming units 39Y, 39M, 39C, and 39K, respectively.

The printer 1 of the present embodiment allows switching between a monochrome mode that forms a monochrome image using toner of a single color (e.g. K color), and a color mode that forms a color image using toner of four colors, i.e. Y, M, C, and K. In an image forming operation according to the color mode, each toner image of Y, M, C, and K formed on the outer circumferential surface of the photosensitive drum (such as 31Y) driven to rotate at a predetermined rotational speed in the image forming units 39Y, 39M, 39C, and 39K is transferred in a superimposing manner onto the same area of the intermediate transfer belt 36 by the primary transfer roller (such as 34Y) of the image forming units 39Y, 39M, 39C, and 39K. In an image forming operation according to the monochrome mode, the toner image formed by the selected one of the image forming units is transferred to a predetermined area of the intermediate transfer belt 36.

It should be noted that toner remaining on the outer circumferential surface of the photosensitive drum (such as 31Y) without being transferred onto the intermediate transfer belt 36 is removed from the outer circumferential surface of the photosensitive drum (such as 31Y) by the cleaner (such as 35Y) upon reaching, as the photosensitive drum (such as 31Y) rotates, a contact portion that contacts the cleaner (such as 35Y). The cleaner (such as 35Y) can be a plate-shaped blade, a fixed brush, a rotating brush, a roller, a combination of a plurality of these members, or the like. Alternatively, instead of providing such a cleaner, a cleaner-less method that collects toner remaining on the outer circumferential surface of the photosensitive drum (such as 31Y) using the developer (such as 33Y) can be employed.

Above the intermediate transfer belt 36, hoppers 22Y, 22M, 22C, and 22K respectively containing toner of Y, M, C, and K colors to be supplied to the developer (such as 33Y) of the image forming units 39Y, 39M, 39C, and 39K are provided. The toner contained in each of the hoppers 22Y, 22M, 22C, and 22K is supplied to the developer (such as 33Y) of the corresponding image forming unit 39Y, 39M, 39C, or 39K.

The sheet conveying part 40 that conveys the recording sheet S includes a sheet supply cassette 41 and a sheet convey path 42. The sheet supply cassette 41 is provided below the exposing device 21 in a removable manner; and the sheet convey path 42 conveys the recording sheet S fed by the sheet supply cassette 41 toward a lateral side of the intermediate transfer belt 36 and the fixing device 50 above the intermediate transfer belt 36. In the sheet supply cassette 41, recording media such as recording sheets S are stacked as recording sheets S, and the uppermost piece of the recording sheets S is fed into the sheet convey path 42 by rotation of a paper feeding roller 43.

In the sheet convey path 42, a secondary transfer roller 45 is provided. The secondary transfer roller 45 opposes, via the intermediate transfer belt 36, the driving roller 38 which drives the intermediate transfer belt 36 to rotate. A transfer nip is formed between the rotation path of the intermediate transfer belt 36 along the circumferential surface of the driving roller 38, and the secondary transfer roller 45. This transfer nip is a secondary transfer part 46 that transfers the toner image onto the recording sheet S. The toner images transferred onto the intermediate transfer belt 36 are secondarily transferred onto the recording sheet S conveyed upward in the sheet convey path 42.

A registration roller pair 44 is provided in the sheet convey path 42 below the secondary transfer part 46. The registration roller pair 44 conveys the recording sheet S fed from the sheet supply cassette 41 at a predetermined timing. The registration roller pair 44 controls the timing of conveying the recording sheet S such that the timing at which the recording sheet S reaches the secondary transfer part 46 matches the timing at which the toner images transferred onto the intermediate transfer belt 36 reach the secondary transfer part 46. The toner image formed on the intermediate transfer belt 36 is transferred by the secondary transfer part 46 onto the recording sheet S conveyed to the secondary transfer part 46 at the predetermined timing by the registration roller pair 44. Subsequently, the recording sheet S is conveyed to the fixing device 50 provided above the secondary transfer part 46.

It should be noted that the intermediate transfer belt 36 which has passed through the secondary transfer part 46 is cleaned by a cleaning blade 23 that is arranged opposing the driven roller 37 via the intermediate transfer belt 36.

The fixing device 50 has a first belt 51 and a second belt 52. The recording sheet S on which the toner image has been secondarily transferred at the secondary transfer part 46 is conveyed upward and passes through a fixing nip between a portion of the first belt 51 and a portion of the second belt 52 which are in pressing contact with each other. The toner image on the recording sheet S is fixed to the recording sheet S by being heated and applied with pressure while passing through the fixing nip. The recording sheet S that has passed through the fixing device 50 is discharged by a sheet discharge roller 61 onto a sheet discharge tray 62 provided above the image processing part 30.

Figure 2:
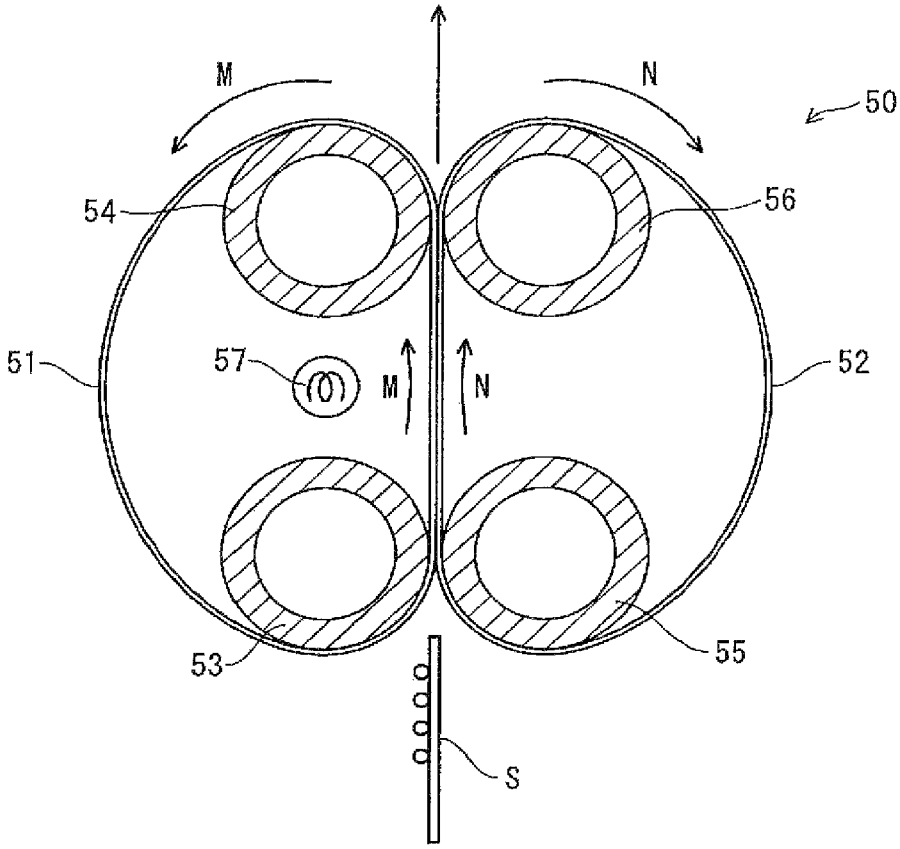
FIG. 2 is a cross-sectional schematic view showing a structure of the fixing device pertaining to the embodiment of the present invention.

FIG. 2 is a schematic diagram for explaining the structure of the fixing device 50. As shown in FIG. 2, the first belt 51 and the second belt 52 of the fixing device 50 apply pressure to the recording sheet S, which has had the toner image transferred on the front surface thereof, at the secondary transfer unit 46 and is conveyed upward, by sandwiching the front surface and the rear surface thereof from left and right, respectively.

Figure 3A:
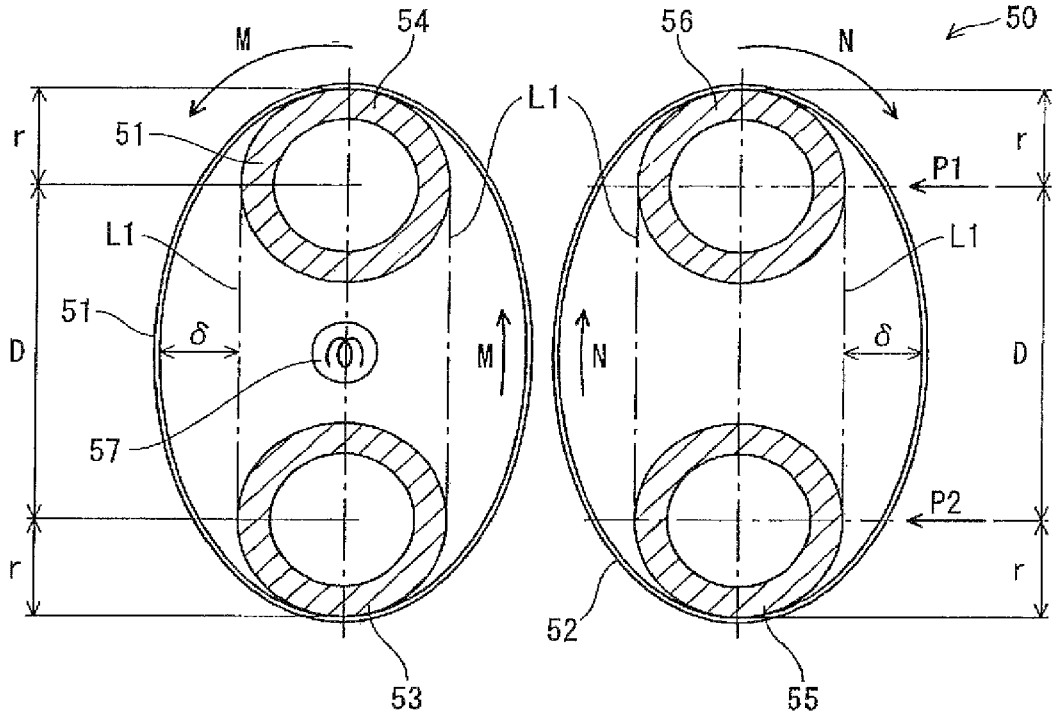
FIG. 3A is a schematic diagram showing a state where a first belt and a second belt are separated from each other to explain the structure of the fixing device.
Figure 3B:
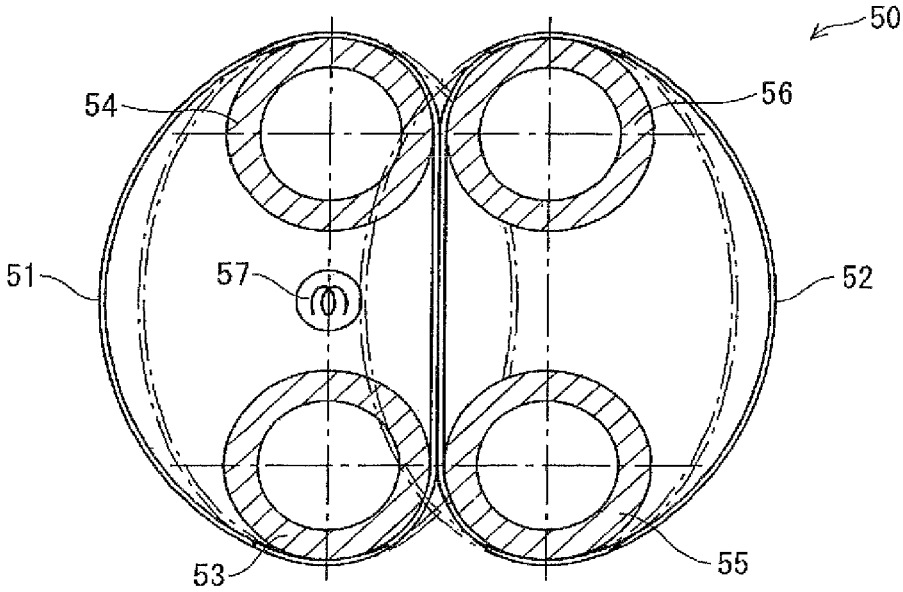
FIG. 3B is a schematic diagram showing a state where the first belt and the second belt are in pressing contact with each other.

FIG. 3A is a schematic diagram showing a state where the first belt 51 and the second belt 52 are separated from each other. The first belt 51 is an endless belt having a predetermined stiffness that maintains, when in a natural state without being suspended on the first upstream roller 53 and the first downstream roller 54, a cylindrical shape with a circular cross-section of the first belt 51. As shown in FIG. 3A, the first belt 51 is suspended on a first upstream roller 53 disposed at the upstream side of the conveying direction of the recording sheet S (lower side) and a first downstream roller 54 disposed, in parallel with the first upstream roller 53, at the downstream side of the conveying direction of the recording sheet S (upper side) with a predetermined tension (belt tension) applied thereto. The stiffness of the first belt 51 allows the first belt 51 to maintain its elliptical shape while rotating when assumed to be separated from the second belt 52.

The first upstream roller 53 and the first downstream roller 54 each have the same radius r, and are aligned in a Y-axis direction (vertical direction) in a manner to have the same X-axis coordinate position (horizontal direction position), with a predetermined inter-axis distance D between the respective centers thereof. When it is assumed that the first belt 51 is in a state of being separated from the second belt 52, the first belt 51 suspended on the first upstream roller 53 and the first downstream roller 54 with the predetermined belt tension applied thereto rotates in the following manner: each of two portions that face each other between the first upstream roller 53 and the first downstream roller 54 run in a outwardly curved state that projects with respect to a corresponding common tangent L1 by the same projection amount (deflection amount) $\delta$. In other words, the two portions of the first belt 51 that oppose each other across an axis passing through the center of the first upstream roller 53 and the center of the first downstream roller 54 project away from each other in a manner that the two portions are arc-shaped. This is due to a force to go back to the state before the tension is applied (restoring force). The first belt 51 is disposed with its outer circumferential surface opposing, of the recording sheet S, the surface having the toner image transferred thereon, and for example, rotates in a direction indicated by an arrow M shown in FIG. 3A according to the rotation of the first downstream roller 54 which is driven to rotate by the drive motor.

At a middle position between the first upstream roller 53 and the first downstream roller 54 inside the rotation path of the first belt 51, a heater lamp 57 in a shape of a cylinder formed in a linear fashion is disposed in parallel with the first upstream roller 53 and the first downstream roller 54. The heater lamp 57 can be a halogen heater, a carbon heater, a xenon lamp heater or the like. Not limited to the heater lamp 57 of such kind, an electric wire heater formed in a linear fashion can also be used.

As with the first belt 51, the second belt 52 is an endless belt having a predetermined stiffness that maintains a cylindrical shape with a circular cross-section of the second belt 52 when in a natural state without being suspended on the first upstream roller 55 and the first downstream roller 56. In the present embodiment, the second belt 52 and the first belt 51 are made of the same material having the same stiffness, and are configured to have the same dimension and the same shape. As shown in FIG. 3A, as with the first belt 51, the second belt 52 is suspended on a second upstream roller 55 disposed at the upstream side of the conveying direction of the recording sheet S (lower side) and a second downstream roller 56 disposed, in parallel with the second upstream roller 55, at the downstream side of the conveying direction of the recording sheet S (upper side), with a predetermined tension (belt tension) applied thereto. The stiffness of the second belt 52 allows the second belt 52 to maintain its elliptical shape while rotating when assumed to be separated from the first belt 51.

The second upstream roller 55 and the second downstream roller 56 each have the same radius r, and are aligned in the Y-axis direction (vertical direction) in a manner to have the same X-axis coordinate position (horizontal direction position), with the predetermined inter-axis distance D therebetween.

When it is assumed that the second belt 52 is in a state of being separated from the first belt 51, the second belt 52 suspended on the second upstream roller 55 and, the second downstream roller 56 with the predetermined belt tension applied thereto rotates in the following manner: each of two portions that face each other between the second upstream roller 55 and the second downstream roller 56 run in a outwardly curved state that projects with respect to a corresponding common tangent L1 by the same projection amount (deflection amount) δ. In other words, the two portions of the second belt 52 that oppose each other across an axis passing through the center of the second upstream roller 55 and the center of the second downstream roller 56 project away from each other in a manner that the two portions are arc-shaped. This is due to a force to go back to the state before the tension is applied (restoring force).

As shown in FIG. 3A, when assumed to be separated from each other, the first belt 51 and the second belt 52 are in a similar elliptical shape. Accordingly, the respective lengths B1 and B2 in the circumferential direction (total lengths) of the first belt 51 and the second belt 52 are equal, and B1 and B2 are each longer than a length that is sum of the length of the two common tangents L1 of the first upstream roller 53 and the first downstream roller 54, the half of the circumferential length of the first upstream roller 53, and the half of the circumferential length of the first downstream roller 54. Because the length of the common tangents L1 is equal to the inter-axis distance D between the first upstream roller 53 and the first downstream roller 54, the circumferential length B1 of the first belt 51 satisfies $B1>2D+2\pi r/2+2\pi r/2$, that is, $B1>2D+2\pi r$. Being equal to the circumferential length B1 of the first belt 51, the circumferential length B2 of the second belt 52 similarly satisfies $B2>2D+2\pi r$.

In the fixing apparatus 50, the first belt 51 and the second belt 52 that each rotate in an elliptical shape when assumed to be separated from each other, as shown in FIG. 3A, are brought in pressing contact with each other at the mutually facing portions thereof, i.e. the portion of the first belt 51 and the portion of the second belt 52 that face each other, such that the mutually facing portions are deformed into flat surfaces.

In this case, an upstream nip portion having a predetermined nip pressure along the X-axis direction is formed between the first belt 51 and the second belt 52 as the first upstream roller 53 and the second upstream roller 55 maintain the same Y-coordinate position and are pressed against each other with a predetermined pressure via the first belt 51 and the second belt 52. Similarly, a downstream nip portion having a predetermined nip pressure along the X-axis direction is formed between the first belt 51 and the second belt 52 as the first downstream roller 54 and the second downstream roller 56 maintain the same Y-coordinate position and are pressed against each other with a predetermined pressure via the first belt 51 and the second belt 52. In the present embodiment, the nip pressure at the upstream nip portion and the nip pressure at the downstream nip portion are equal.

Figure 4:
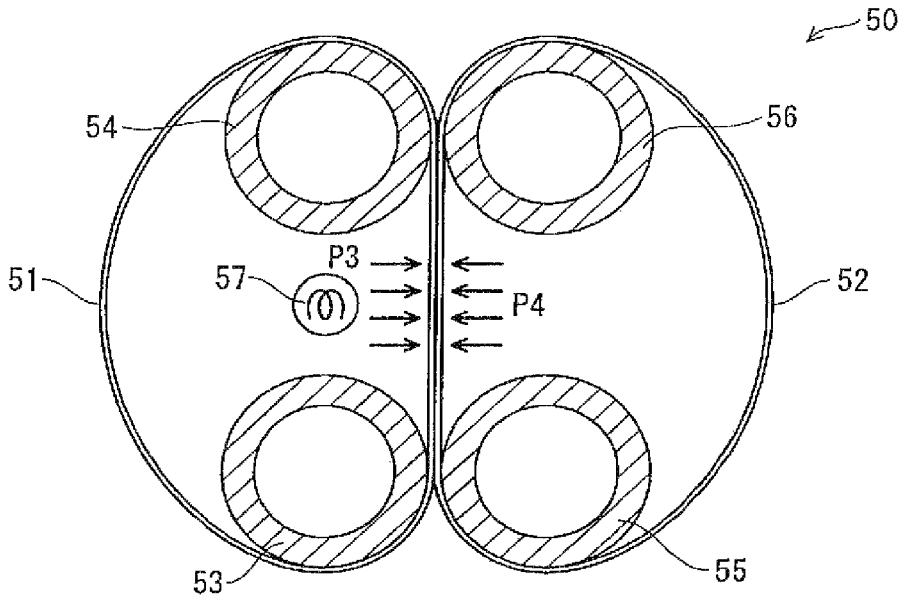
FIG. 4 is a schematic diagram for explaining the fixing device in a state where pressure is applied to a portion of the first belt and a portion of the second belt that are in pressing contact with each other.

As described above, one of the two portions of the first belt 51 that are able to run in an outwardly projecting curved state between the first upstream roller 53 and the first downstream roller 54, and one of the two portions of the second belt 52 that are able to run in an outwardly projecting curved state between the second upstream roller 55 and the second downstream roller 56, respectively, under the assumption that the first belt 51 and the second belt 52 are separated from each other, are brought into pressing contact with each other. Consequently, as shown in FIG. 4, the one of the two portions of the first belt 51 and the one of the two portions of the second belt 52 which are brought into pressing contact with each other are applied with a pressure P3 by the stiffness of the first belt 51 and a pressure P4 by the stiffness of the second belt 52. As a result, the outward projection amount δ of the portions, of the first belt 51 and the second belt 52, which are in pressing contact with each other become smaller, while the respective other ones of the two portions of the first belt 51 and the second belt 52, which are out of contact with each other and positioned opposite from the respective portions of the first belt 51 and the second belt 52 that are in pressing contact with each other, rotate in a deformed state with an increased outward projection amount δ. Accordingly, the other one of the two portions of the first belt 51 and the other one of the two portions of the second belt 52 that are out of mutual contact each project further with respect to the respective rotation paths of the first belt 51 and the second belt 52 under the assumption that the first belt 51 and the second belt 52 are in the state of being separated from each other.

In the present embodiment, the pressure P3 due to the stiffness of the first belt 51 itself and the pressure P4 of due to the stiffness of the second belt 52 itself are equal, and at the mutually pressed portions of the first belt 51 and the second belt 52, the projection amount $\delta=0$. Accordingly, the mutually pressed portions of the first belt 51 and the second belt 52 are flat at the intermediate nip portion formed throughout the area between the upstream nip portion and the downstream nip portion.

Figure 5:
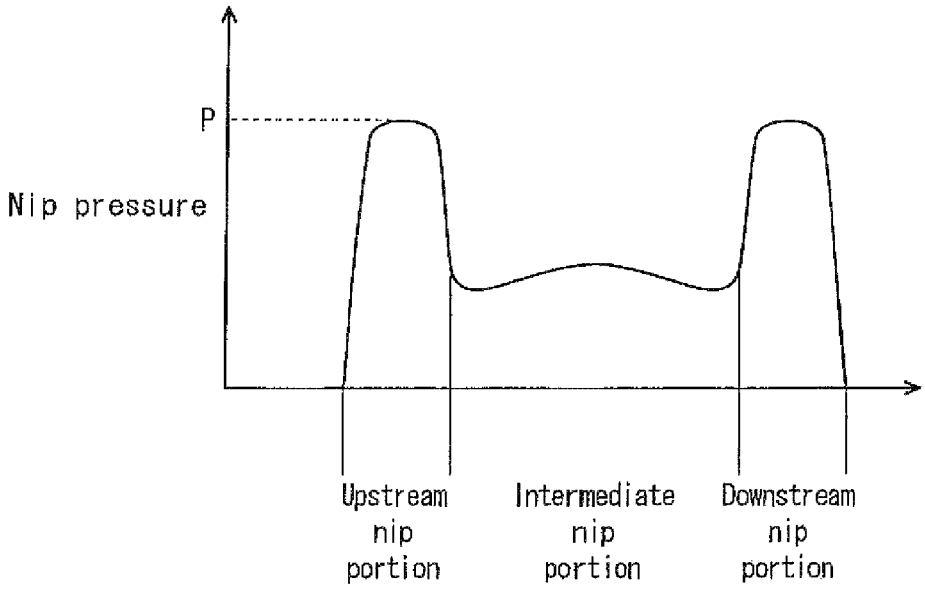
FIG. 5 is a graph showing a distribution of a nip pressure of a fixing nip between the first belt and the second belt of the fixing device.

As described above, because the mutually opposing portions of the first belt 51 and the second belt 52 are in pressing contact with each other at the intermediate nip portion by the pressure P3 due to the stiffness of the first belt 51 and the pressure P4 due to the stiffness of the second belt 52, a high nip pressure is formed at the intermediate nip portion. FIG. 5 shows the distribution of the nip pressure at the fixing nips of the fixing device in the present embodiment. Although being lower than the nip pressure at the upstream nip portion and at the downstream nip portion, the nip pressure at the intermediate nip portion is secured to be approximately ½ of the nip pressure at the upstream nip portion and at the downstream nip portion. With the above-described structure, the second belt 52 rotates in the direction indicated by an arrow N in FIG. 2 according to the rotation of the first belt 51.

The first belt 51 and the second belt 52 include a predetermined thickness of a base material composed of, for example, a material with a high elastic modulus (Young's modulus) such as Ni (nickel), iron, SUS (stainless steel), W (tungsten), or PI (polyimide). The thickness of the base material can be, for example, 20-400 μm, and more preferably 100-200 μm. This base material has been fabricated into a cylindrical shape having a cross-section of a predetermined outer diameter, and is endless.

A surface layer such as laminated fluorine resin tubes (e.g. PFA, PTFA, or ETFA), laminated silicon rubber tubes, or the like may be provided on the surface (outer circumferential surface) of the base material to provide releasing properties. The surface layer may have conductivity. The surface layer may be formed by coating the base material. The thickness of the surface material is preferably about 5 μm to 100 μm. As the surface layer, for example, a fluorine resin such as a product "PFA350-J", "451HP-J", or "9541HP Plus" of DU PONT-MITSUI FLUOROCHEMICALS COMPANY, LTD can be suitably used.

Additionally, an interlayer may be provided between the base material and the surface layer. The interlayer is preferably composed of a material having elasticity and highly heat-resistant, such as silicon rubber or fluorine rubber. It is preferable that, when in the natural state without being suspended on the first upstream roller 53 and the first downstream roller 54, the first belt 51 be in a cylindrical shape with an outer diameter thereof in a range of 30 mm to 150 mm, approximately. Similarly, it is preferable that, when in the natural state without being suspended on the second upstream roller 55 and the second downstream roller 56, the second belt 52 be in a cylindrical shape with an outer diameter thereof in a range of 30 mm to 150 mm, approximately.

It is preferable that the first belt 51 and the second belt 52 each satisfy the following relationship:

$$E \cdot t/\phi \leqq 2{,}000{,}000 \ (\mathrm{mN/mm^2}) \quad (1)$$

where E ($mN/mm^2$) is the Young's modulus, ϕ (mm) is the outer diameter of the cross-section of the cylindrical shape when no belt tension is applied, and t (mm) is the thickness, of the first belt 51 and the second belt 52.

As the Young's modulus E and the thickness t increase, the first belt 51 and the second belt 52 require higher belt tension to be deformed into an elliptical shape. However, as the outer diameter of the cylindrical shape increases, the first belt 51 and the second belt 52 can be deformed into an elliptical shape more easily. Accordingly, in order to deform the first belt 51 and the second belt 52 into a desired elliptical shape, the first belt 51 and the second belt 52 preferably satisfy the relationship represented by the expression (1) above. The value 2000000 ($mN/mm^2$) was determined empirically.

Also, a pressure load W applied to the second belt 52 by bringing the portion in the curved state of the first belt 51, which has been deformed into an elliptical shape with a length L in the major axis direction and the projection amount δ mm, into pressing contact with the portion of the second belt 52 is determined by the following expression (2), based on a computational expression for calculating beam deflection amount. Note that b is a belt width (mm).

$$W = 1000 \cdot 384 \cdot E \cdot b \cdot t^3 \cdot \delta / 12 \cdot L^3 \quad (2)$$

Consequently, a pressure load per unit width W/b (mN/mm) of the first belt 51 is represented by the following equation (3).

$$W/b = 1000 \cdot 384 \cdot E \cdot b \cdot t^3 \cdot \delta / 12 \cdot L^3 \quad (3)$$

It is known that in fixing devices, the fixing temperature for melting toner images can be lowered by increasing the nip pressure at the fixing nip. The table in FIG. 6 shows relationships between pressure loads W/b (mN/mm) by the first belt 51 and fixing temperatures when the fixing device 50 shown in FIG. 2 fixes a toner image (formed by the wet granulation method using toner having a volume average particle diameter of about 6.5 μm) to plain paper.

Figures 6, 7:
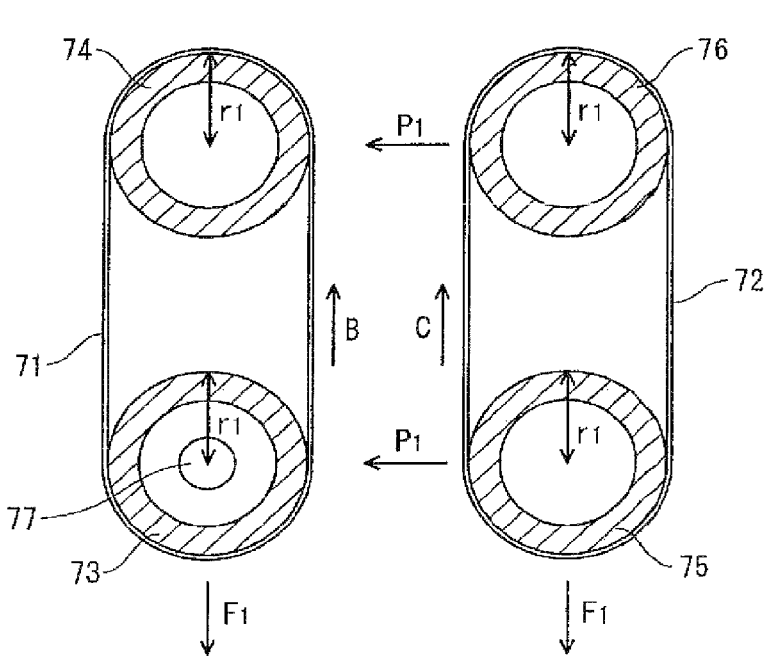
FIG. 7 Prior Art
FIG. 6 is a table showing a relationship between pressure loads W/b (mN/mm) and fixing temperatures.
FIG. 7 is a cross-sectional schematic view showing a general structure of a conventional fixing device.
Figure 8:
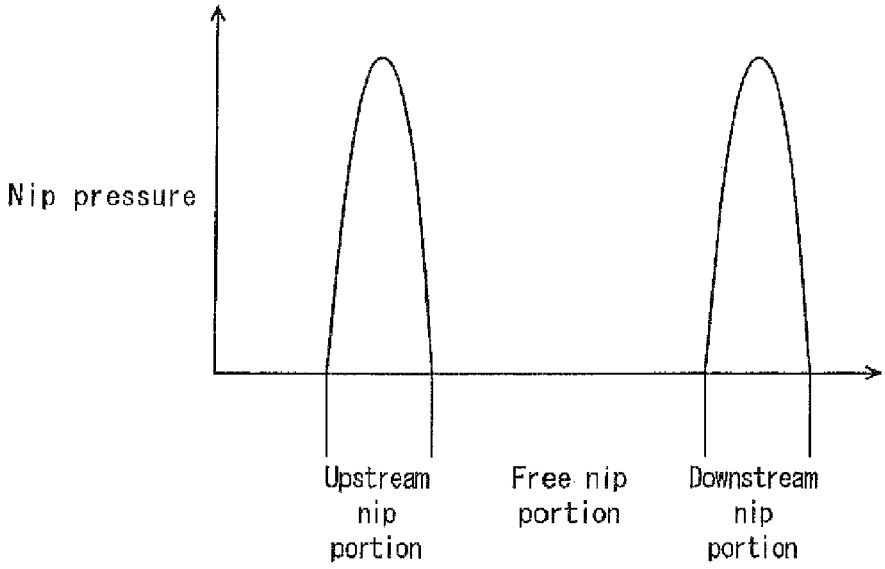
FIG. 8 Prior Art
FIG. 8 is a graph showing a distribution of a nip pressure of a fixing nip between a pair of belts in the conventional fixing device.

According to the table in FIG. 6, when the pressure load per unit width W/b (mN/mm) of the first belt 51 is 1 or higher, the toner image can be fixed at a fixing temperature of 190° C., which is lower than a fixing temperature of 220° C., with a sufficient fixability which prevents toner detachment. When the pressure load W/b (mN/mm) is 10 or higher, because of the higher pressing force, the toner image can be fixed with a sufficient fixability at a further lower fixing temperature of 170° C. or higher. Furthermore, when the pressure load W/b (mN/mm) is 100 or higher, the toner image can be fixed with a sufficient fixability at an even lower fixing temperature of 150° C.

Accordingly, when the pressure load per unit width W/b (mN/mm) of the first belt 51 in the elliptical shape is or higher, the fixing temperature can be set at approximately 190° C.; when the pressure load W/b (mN/mm) is 10 or higher, the warm-up time can be reduced by lowering the fixing temperature further; and when the pressure load W/b (mN/mm) is 100 or higher, the warm-up time can be significantly reduced.

With the heat capacity and the like taken into consideration, the thickness t of the first belt 51 and the second belt 52 is preferably around 20 μm to 400 μm, and more preferably, around 100 μm to 200 μm. Since the higher the pressure load per unit width W/b (mN/mm) of the first belt 51 and the second belt 52 is, the more preferable it is, a base material having high Young's modulus E is preferable. Specifically, it is preferable to use a base material with the Young's modulus E of 100,000 $N/mm^2$ or higher.

In the fixing device 50 with the above-described structure, when the recording sheet S on which the toner image was transferred by the secondary transfer part 46 is conveyed, the recording sheet S enters the upstream nip portion between the first belt 51 and the second belt 52, passes through the intermediate nip portion between the portion of the first belt 51 and the portion of the second belt 52 which have become flat as a result of being brought into pressing contact with each other, passes through the downstream nip portion between the first belt 51 and the second belt 52, and is discharged.

A predetermined high nip pressure P is provided at the upstream nip portion by the first upstream roller 53 and the second upstream roller 55. A predetermined nip pressure P is provided at the downstream nip portion by the first downstream roller 54 and the second downstream roller 56.

The toner image on the recording sheet S is heated into a molten state by the heater lamp 57 and fixed by being pressed against the recording sheet S while passing through the upstream nip portion, the intermediate nip portion, and the downstream nip portion.

In this case, as shown in FIG. 5, a substantially constant, relatively high nip pressure is secured throughout the intermediate nip portion. Consequently, the toner image on the recording sheet S is reliably applied with a pressure, whereby image slippage is suppressed. Additionally, because a relatively high nip pressure is applied at the intermediate nip portion, vibration of the recording sheet S is also suppressed, and as a result, occurrence of creases of the recording sheet S at the downstream nip portion is suppressed.

Furthermore, because the intermediate nip portion providing a high nip pressure is formed by the first belt 51 and the second belt 52 having a stiffness, it is not necessary to provide any special members for securing a nip pressure. Accordingly, the heat capacity of the fixing device 50 is unlikely to increase, and the warm-up time required for raising the temperature of the fixing nip portion to a predetermined temperature can be reduced, thereby promoting energy-saving.

Note that the fixing device 50 of the present invention is not limited to the above-described embodiment. For example, it is not limited to the structure where the heater lamp 57 is provided only between the upstream roller 53 and the first downstream roller 54. Another heater can be provided in addition to the heater lamp 57.

For example, when the first upstream roller 53 and the second upstream roller 55 each have a hollow core bar, a heater lamp can be provided in each core bar. In this case, a heater such as a heater lamp may be provided only in the core bar of one of the first upstream roller 53 and the second upstream roller 55.

Furthermore, in addition to the heater lamp 57, a heater such as a heater lamp can be also provided between the second upstream roller 55 and the second downstream roller 56. According to any of these structures, heating efficiency of the fixing nip portion can be improved, which enables further reduction of the warm-up time.

The heater is not limited to the heater lamp 57, an electric coil heater, or the like, and for example, the first belt 51 may be heated by a heater according to an electromagnetic induction heating method using a structure such as follows: an induction heating body is provided at the first belt 51; and a pair of excitation coils are arranged opposing a belt portion of the first belt 51, in the rotating direction of the first belt 51, the belt portion being positioned away from the second belt 52.

Furthermore, according to the structure of the above-described embodiment, the first downstream roller 54 is driven to rotate, the first belt 51 rotates according to the rotation of the first downstream roller 54, and the second belt 52 rotates according to the rotation of the first belt 51. However, the structure is not limited to this. Instead, the second downstream roller 56 may be driven to rotate by a drive motor to rotate the second belt 52, thereby causing the first belt 51 to rotate according to the rotation of the second belt 52. Or a structure in which the first upstream roller 53 and the second upstream roller 55 are driven to rotate, a structure in which either the first upstream roller 53 and the first upstream roller 54 or the second upstream roller 55 and the second downstream roller 56 are driven to rotate, or a structure in which all of the four rollers 53-56 are driven to rotate can be applied.

Furthermore, in the embodiment above, the first belt 51 is disposed facing, of the recording sheet S, the surface on which the toner image has been fixed. However, the second belt 52 may be disposed facing the surface on which the toner image has been fixed.

Also, it is not limited to the structure where the first upstream roller 53 and the first downstream roller 54 are disposed opposing the second upstream roller 55 and the second downstream 56, respectively. As long as the nip pressure can be secured, the second upstream roller 55 can be disposed more downstream or more upstream than the first upstream roller 53, and the second downstream roller 56 can be disposed more downstream or more upstream than the first downstream roller 54, respectively. Additionally, the four rollers do not need to have an equal outer diameter, and can have an arbitrary outer diameter.

Furthermore, although the first belt 51 and the second belt 52 each form an elliptic-shaped rotating path when they are assumed to be separated from each other according to the above embodiment, the structure is not limited to this. It can be any structure as long as the first belt 51 and the second belt 52 have a stiffness such that belt portions between the first upstream roller 53 and the first downstream roller 54 and belt portions between the second upstream roller 55 and the second downstream roller each form an outwardly projecting curvature when the first belt 51 and the second belt 52 are assumed to be separated from each other. Additionally, the first belt 51 and the second belt 52 are not limited to have the same stiffness, and can have different stiffness.

The image forming apparatus to which the fixing device pertaining to the present invention is applied is not limited to a tandem-type color digital printer. It can be, for example, a so-called four-cycle type image forming apparatus or a monochrome image forming apparatus. The four-cycle type image forming apparatus has four imaging devices around the rotation axis and forms a full-color image by making these four imaging devices face the electrostatic latent image carrier sequentially. The monochrome image forming apparatus has only one imaging device. Also, the fixing device of the present invention can be applied to copiers, facsimiles, MFPs (Multiple Function Peripheral), and the like, in addition to printers.

Although the present invention has been fully described by way of examples with reference to the accompanying drawings, it is to be noted that various changes and modifications will be apparent to those skilled in the art. Therefore, unless such changes and modifications depart from the scope of the present invention, they should be construed as being included therein.

The present invention enables a fixing device that thermally fixes an unfixed image by heat and pressure using a pair of belts to stably secure a high nip pressure for a long period of time without providing a member which is slidably in contact with the inner surface of a belt, and also to reduce the warm-up time.

What is claimed is:

1. A fixing device that fixes an unfixed image formed on a recording sheet to the recording sheet by applying heat and pressure to the unfixed image when the recording sheet passes through a fixing nip, the fixing device comprising:

a first belt and a second belt in pressing contact with each other so as to form the fixing nip, the first belt being rotatably suspended on a pair of first rollers including a first upstream roller and a first downstream roller, and the second belt being rotatably suspended on a pair of second rollers including a second upstream roller and a second downstream roller;

the first and second belts have a stiffness such that, prior to configuring the first belt and the second belt in pressing contact with each other, (a) two portions of the first belt that oppose each other across a first axis passing through a center of each of the first rollers project away from each other in a manner that the two portions are arc-shaped, and (b) two portions of the second belt that oppose each other across a second axis passing through a center of each of the second rollers project away from each other in a manner that the two portions of the second belt are arc-shaped;

one of the two portions of the first belt and one of the two portions of the second belt form the fixing nip when the first belt and the second belt are configured in pressing contact with each other; and wherein a length of the fixing nip is greater than or equal to a distance separating the center of the first upstream roller and the center of the first downstream roller.

2. The fixing device of claim 1, wherein when the one of the two portions of the first belt and the one of the two portions of the second belt are configured in pressing contact with each other, an other one of the two portions of the first belt projects further in a direction away from the one of the two portions of the first belt and an other one of the two portions of the second belt projects further in a direction away from the one of the two portions of the second belt, respectively, than prior to the first and second belts being configured in pressing contact with each other.

3. The fixing device of claim 2, wherein the one of the two portions of the first belt and the one of the two portions of the second belt that are in pressing contact with each other are flat.

4. The fixing device of claim 1, wherein each of the first rollers and a corresponding one of the second rollers are pressed against each other via the first and second belts.

5. The fixing device of claim 1, wherein a pressure load per unit width denoted by W/b (mN/mm) applied to the second belt by the first belt satisfies W/b (mN/mm)≧1, where W=1000·384·E·b·t3·δ/12·L3, E (mN/mm2) is Young's modulus of the first belt, t (mm) is a thickness of the first belt, b (mm) is a width of the first belt, and δ (mm) is a projection amount by which a furthest-projecting point of each of the two portions of the first belt projects, in a direction orthogonal to the first axis, with respect to a corresponding common tangent line of the first rollers prior to the first belt being configured in pressing contact with the second belt.

6. The fixing device of claim 5, wherein W/b (mN/mm)≧10.

7. The fixing device of claim 5, wherein W/b (mN/mm)≧100.

8. The fixing device of claim 5, wherein when in a natural state without being suspended on the first rollers, the first belt is an endless belt in a circular cylindrical shape with a transverse cross section thereof having an outer diameter of ϕ(mm), and satisfies the following expression: 100000≦E·t/ϕ≦2000000 (mN/mm2).

9. The fixing device of claim 1, wherein the unfixed image formed on the recording sheet is heated by a heater provided between the first rollers positioned inside a rotation path of the first belt.

10. The fixing device of claim 9, wherein the heater is one of a heater lamp and an electric coil heater.

11. The fixing device of claim 1, wherein the unfixed image formed on the recording sheet is heated by a heater according to an electromagnetic induction heating method.

12. An image forming apparatus that fixes an unfixed image formed on a recording sheet, using a fixing part, the image forming apparatus comprising the fixing device of claim 1 as the fixing part.

13. The fixing device of claim 1, wherein the first belt and the second belt are made of a same material having a same stiffness, and are configured to have a same dimension and a same shape.

14. The fixing device of claim 1, wherein the one of the two portions of the first belt forming the nip is flat so that the fixing nip is formed by a flattened portion of the first belt possessing a length greater than or equal to the distance separating the center of the first upstream roller and the center of the first downstream roller.

15. The fixing device of claim 1, wherein the pressing contact between the first belt and the second belt creates varying pressure along the fixing nip so that the pressure near opposing ends of the fixing nip is higher than the pressure near a middle portion of the fixing nip.

16. A fixing device configured to fix an unfixed image formed on a recording sheet to the recording sheet by applying heat and pressure to the unfixed image, the fixing device comprising:

a first pair of rollers including a first upstream roller and a first downstream roller;

a second pair of rollers including a second upstream roller and a second downstream roller;

a center of the first upstream roller being aligned along a first axis with a center of the second upstream roller;

a center of the first downstream roller being aligned along a second axis with a center of the second downstream roller, wherein the second axis is parallel to the first axis;

a first belt rotatably supported by the first pair of rollers so that the first belt is configured to rotate around the first pair of rollers;

a second belt rotatably supported by the second pair of rollers so that the second belt is configured to rotate around the second pair of rollers;

the first belt and the second belt being configured to contact each other as the first belt and the second belt rotate between the first pair of rollers and the second pair of rollers so as to form a nip extending at least between the first axis and the second axis;

the first belt and the second belt being configured to apply opposing forces to each other along the entire nip;

the first belt having a stiffness such that the first belt has a curved shape as the first belt rotates through a position where the first belt contacts neither the second belt nor the first pair of rollers; and the second belt having a stiffness such that the second belt has a curved shape as the second belt rotates through a position where the second belt contacts neither the first belt nor the second pair of rollers.

17. The fixing of device of claim 16, wherein the first belt and the second belt are configured to flatten as the first belt and the second belt pass through the nip so that the nip is formed by a flat portion of the first belt extending between the first axis and the second axis and a flat portion of the second belt extending between the first axis and the second axis.

18. The fixing of device of claim 16, wherein the opposing forces of the first belt and the second belt create varying pressure along the nip so that the pressure near opposing ends of the nip is higher than the pressure near a middle portion of the nip.

* * * * *